US010455915B2

(12) United States Patent
Wilkin et al.

(10) Patent No.: US 10,455,915 B2
(45) Date of Patent: Oct. 29, 2019

(54) PERSONAL WHEELED CONTAINER EXTERIOR SUPPORT SHELF

(71) Applicants: Russell Wilkin, Henderson, NV (US); Mary Purdy, Lake Havasu City, AZ (US)

(72) Inventors: Russell Wilkin, Henderson, NV (US); Mary Purdy, Lake Havasu City, AZ (US)

(73) Assignees: Russell Wilkin, Henderson, NV (US); Mary Purdy, Lake Havasu City, AZ (US)

( * ) Notice: Subject to any disclaimer, the term of this patent is extended or adjusted under 35 U.S.C. 154(b) by 0 days.

(21) Appl. No.: 15/846,048

(22) Filed: Dec. 18, 2017

(65) Prior Publication Data

US 2018/0168308 A1 Jun. 21, 2018

Related U.S. Application Data

(60) Provisional application No. 62/435,408, filed on Dec. 16, 2016.

(51) Int. Cl.

| | |
|---|---|
| ***A45C 5/06*** | (2006.01) |
| ***A45C 13/28*** | (2006.01) |
| ***A45C 5/03*** | (2006.01) |
| ***A45C 13/26*** | (2006.01) |
| ***A45C 5/14*** | (2006.01) |
| ***A45C 13/00*** | (2006.01) |

(52) U.S. Cl.

CPC ..... *A45C 13/28* (2013.01); *A45C 5/03* (2013.01); *A45C 5/14* (2013.01); *A45C 13/001* (2013.01); *A45C 13/262* (2013.01); *A45C 2013/267* (2013.01); *A45C 2200/00* (2013.01)

(58) Field of Classification Search

CPC ..... A45C 13/262; A45C 5/06; A45C 9/00; A45C 2013/226; A45C 5/14; A45C 2013/267; A45C 13/28; A45C 7/0086

USPC ..... 190/112, 115, 11, 12 A, 108, 10, 102; 206/218

See application file for complete search history.

(56) References Cited

U.S. PATENT DOCUMENTS 4,564,091 A * 1/1986 Coneglio ..... A45C 3/02 108/102
5,054,783 A * 10/1991 Hull ..... A45C 9/00 190/11
5,366,071 A * 11/1994 Laszlo ..... A01K 97/26 206/218

(Continued)

*Primary Examiner* — Sue A Weaver
(74) *Attorney, Agent, or Firm* — McAfee & Taft

(57) ABSTRACT

A personal wheeled container exterior support shelf that can be attached to an existing personal wheeled container is provided. The exterior support shelf comprises an elongated support member, the support member having a longitudinal axis and including a pair of plates that form a cavity that extends along the longitudinal axis of the support member, and a shelf extension assembly. The shelf extension assembly includes a pair of extendable/retractable shelf extensions that can be extended from and retracted into the cavity through an open end of the support member to extend the length of the support member along its longitudinal axis beyond each side of the wheeled personal container. A personal wheeled container is also provided.

11 Claims, 8 Drawing Sheets

(56) References Cited

U.S. PATENT DOCUMENTS

| | | | | |
|---|---|---|---|---|
| 6,454,064 | B1 * | 9/2002 | Cheng | A45C 9/00 190/11 |
| 7,114,612 | B2 * | 10/2006 | Meyer | B65G 25/065 198/750.2 |
| 7,232,018 | B1 * | 6/2007 | Salander | A45C 5/14 190/103 |
| 7,543,704 | B2 * | 6/2009 | Miller | B25H 1/04 190/11 |
| 8,561,769 | B2 * | 10/2013 | Andochick | A45C 5/14 190/18 A |
| 9,380,847 | B1 * | 7/2016 | Killebrew | A45C 9/00 |
| 9,492,904 | B1 * | 11/2016 | Dunn | B23Q 3/18 |
| 2006/0266604 | A1 * | 11/2006 | Chou | A45C 7/0063 190/115 |
| 2014/0054299 | A1 * | 2/2014 | Kamin | F25D 23/00 220/592.2 |
| 2016/0060016 | A1 * | 3/2016 | Angelozzi | A45F 3/46 220/592.2 |

* cited by examiner

PERSONAL WHEELED CONTAINER EXTERIOR SUPPORT SHELF

CROSS-REFERENCE TO RELATED APPLICATION

This application claims the benefit of prior-filed U.S. provisional application No. 62/435,408 (filed on Dec. 16, 2016), which is incorporated by reference herein.

BACKGROUND

To many, one of the greatest innovations to luggage in recent times is the addition of wheels and extendable/retractable pull handles that allow the luggage to be more easily personally transported into and out of airports, hotels and the like. Wheels and pull handles have also been added to other personal containers such as ice chests, briefcases and tool boxes, for example, to allow the containers to be more easily transported from place to place.

Due to the position of the extendable/retractable pull handles with respect to the tops of the containers when the pull handles are in their extended position, users often place supplemental items on top of the containers to transport the supplemental items with the containers. When the containers are tilted by the user and moved, the extended pull handles provide a support that helps prevent the supplemental items from sliding off the containers. For example, it is a common practice to place a piece of carry-on luggage on top of a primary piece of wheeled luggage such that the carry-on luggage can be wheeled around with the primary luggage. Similarly, it is a common practice to place supplies on top of a wheeled ice chest such that the supplies can be wheeled from point to point with the ice chest.

Unfortunately, although an extended pull handle greatly facilitates the ability to transport a supplemental item on a wheeled container by helping to prevent the supplemental item from sliding off the container, it is not fail proof. For example, even though it is positioned on top of the container and rests against the pull handle during transport, a supplemental item can easily fall off the container if its center of gravity moves sufficiently one direction or another with respect to the handle. Also, for example, a supplemental item may simply be too big to easily stay on top of the container during transport.

SUMMARY

In one aspect, a personal wheeled container exterior support shelf that can be attached to an existing personal wheeled container is provided. The personal wheeled container exterior support shelf comprises an elongated support member, the support member having a longitudinal axis and including: an upper plate, an opposing lower plate, and a pair of side members that each extend along the longitudinal axis of the support member and attach the upper plate and the lower plate together, wherein the upper plate and the lower plate are attached together by the side members in a manner such that the upper plate and the lower plate are coplanar to one another and spaced apart to form a cavity between the upper plate and the lower plate that extends though the support member along the longitudinal axis of the support member; a pair of opposing open ends, each open end forming an opening to the cavity; and a shelf extension assembly, the shelf extension assembly including a pair of extendable/retractable shelf extensions that are each attached to the support member, wherein each shelf extension can be extended from and retracted into the cavity through an open end of the support member to extend the length of the support member along its longitudinal axis beyond each side of the wheeled personal container.

In another aspect, a personal wheeled container is provided.

In one embodiment, the personal wheeled container comprises: a body including a first end, a second end opposing the first end, a pair of opposing sides attaching the first end and the second end together, a top, and a bottom opposing the top, the body having an outside surface; one or more wheels attached to the body; a pull handle attached to the body; and an exterior support shelf removably attached to the outside surface of the body. The exterior support shelf is the exterior support shelf described above and provided herein.

In another embodiment, the personal wheeled container has an exterior support shelf assembly integrated therein. In this embodiment, the personal wheeled container comprises: a body including a first end, a second end opposing the first end, a pair of opposing sides attaching the first end and the second end together, a top, and a bottom opposing the top, the body having an outside surface; one or more wheels attached to the body; a pull handle attached to the body; and an exterior support shelf assembly attached to the body and integrated into the container. The exterior support shelf includes: a pair of opposing shelf housings positioned in the body of the container, each shelf housing being positioned adjacent to the first end of the body and adjacent to a side of the container and including a top, an opposing bottom spaced from the top, a rear end connecting the top and bottom together and an open front end opposing the rear end, wherein each side of the body includes an opening over an open front end of a corresponding shelf housing; and a shelf extension subassembly attached to the exterior support shelf assembly, the shelf extension subassembly including an extendable/retractable shelf extension positioned within each shelf housing, wherein each shelf extension can be extended from within and retracted into the corresponding housing through the corresponding opening in the corresponding side of the body in order to longitudinally extend the shelf extension beyond each side of the body.

BRIEF DESCRIPTION OF THE DRAWINGS

The drawings included with this application illustrate certain aspects of the specific embodiments of the personal wheeled container exterior support shelf and personal wheeled container disclosed herein. However, the embodiments disclosed herein and shown by the drawings should not be viewed as exclusive embodiments. The subject matter disclosed herein is capable of considerable modifications, alterations, combinations, and equivalents in form and function, as will occur to those skilled in the art with the benefit of this disclosure. Also, the various views in the drawings may be shown in different scales in order to illustrate the personal wheeled container exterior support shelf and personal wheeled container. The various views in the drawings are not representative of the size of the support shelf, the personal wheeled container or the actual components thereof. As used herein, terms of orientation such as vertical, horizontal, outwardly, inwardly, downwardly and upwardly with respect to the exterior support shelf and personal wheeled container are to be construed in view of the manner in which the exterior support shelf and personal wheeled container are positioned and oriented in the drawings.

FIG. 8A is a side view of another embodiment of the personal wheeled container of the present disclosure, showing a supplemental piece of luggage positioned thereon.

FIG. 8B is the opposing side view of the embodiment of the personal wheeled container shown by FIG. 8A, without a supplemental piece of luggage positioned thereon.

FIG. 9A is a rear view of the embodiment of the personal wheeled container shown by FIGS. 8A and 8B.

FIG. 9B is a front view of the embodiment of the personal wheeled container shown by FIGS. 8A, 8B and 9A, showing a supplemental piece of luggage positioned thereon.

DETAILED DESCRIPTION

Figure 1:
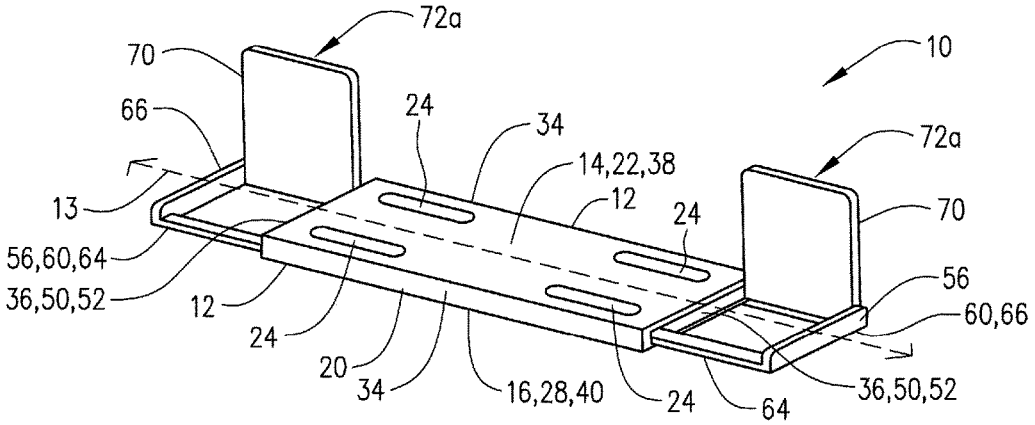
FIG. 1 is a top perspective view illustrating one embodiment of the personal wheeled container exterior support shelf of the present disclosure, with the shelf in an extended position and the flaps in an open position.
Figure 2:
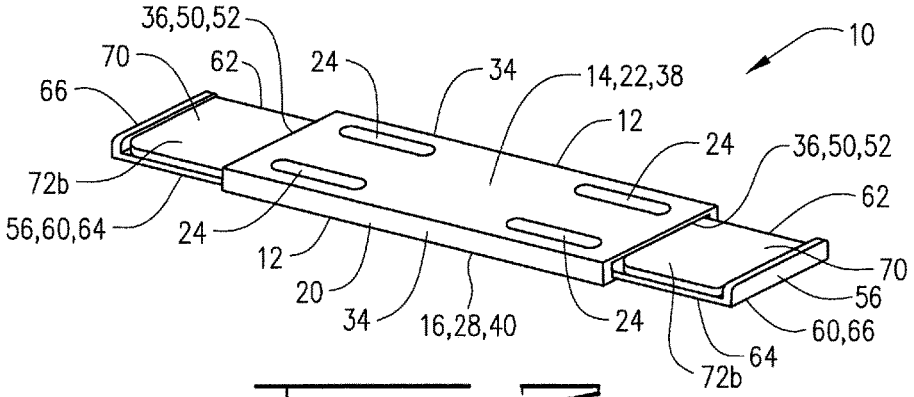
FIG. 2 is another top perspective view of the embodiment of the personal wheeled container exterior support shelf shown by FIG. 1, with the shelf in an extended position and the flaps in a closed position.
Figure 3:
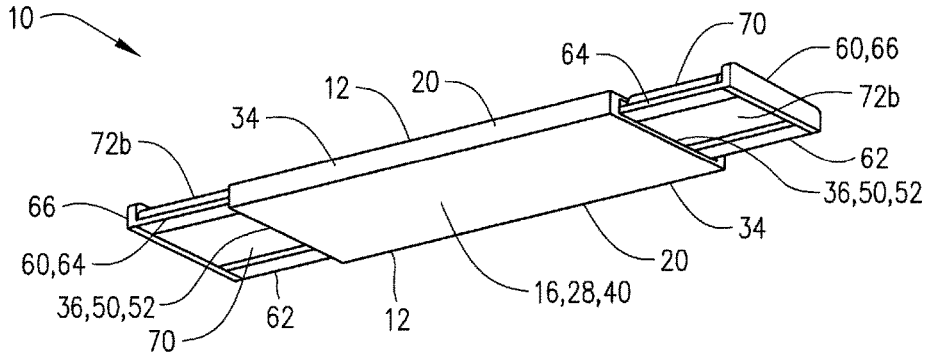
FIG. 3 is a bottom perspective view of the embodiment of the personal wheeled container exterior support shelf shown by FIG. 2.

The present disclosure may be understood more readily by reference to this detailed description as well as to the specific embodiments described herein. For simplicity and clarity of illustration, where appropriate, reference numerals may be repeated among the different figures to indicate corresponding or analogous elements. In addition, numerous specific details are set forth in order to provide a thorough understanding of the disclosed subject matter. However, it will be understood by those of ordinary skill in the art that the subject matter described herein can be practiced without these specific details. In other instances, for example, components have not been described in detail so as not to obscure the related relevant feature being described. Also, the description is not to be considered as limiting the scope of the subject matter described herein. The drawings are not necessarily to scale and the proportions of certain parts may have been exaggerated to better illustrate details and features of the present disclosure.

In one aspect, this disclosure includes a personal wheeled container exterior support shelf that can be attached to an existing personal wheeled container. In another aspect, this disclosure includes a personal wheeled container. As used herein, a personal wheeled container means a container that is designed to be pushed or pulled by an individual user and includes: a) one or more wheels attached to the container and extending outwardly from a surface of the container; and b) a pull handle attached to the container and extending outwardly from a surface of the container, whereby the pull handle can be used by the user to tilt the container toward the user and/or pull or push the container on its wheel(s).

The Personal Wheeled Container Exterior Support Shelf

Referring now to FIGS. 1-5, the personal wheeled container exterior support shelf disclosed herein is illustrated and generally designated by the numeral 10.

The support shelf 10 includes an elongated support member 12 that has a longitudinal axis 13. The support member 12 includes an upper plate 14, an opposing lower plate 16, and a pair of side members 20 that each extend along the longitudinal axis of said support member and attach the upper plate and the lower plate together. For example, the side members 20 are parallel to one another. The upper plate 14 has a rectangular shape and includes a top side 22 and a plurality of slots 24 therein. The lower plate 16 has also has a rectangular shape and includes a bottom side 28. The lower plate 16 is attachable to the top surface of a personal wheeled container adjacent to the pull handle of the container (for example, the first end 102 of the container shown by FIGS. 6 and 7 and described below). For example, the lower plate 16 can be removably attachable to the top surface of the personal wheeled container (for example, the first end 102 of the container shown by FIGS. 6 and 7 and described below).

The upper plate 14 and the lower plate 16 are attached together by the side members 20 in a manner such that the upper plate and the lower plate are coplanar to one another and spaced apart to form a cavity 50 between the upper plate and the lower plate that extends through the support member 12 along the longitudinal axis 13 of the support member. For example, the cavity 50 can have a rectangular shape.

The elongated support member 20 has a rectangular shape overall and further includes a pair of opposing open ends 36, each open end forming an opening 52 to the cavity 50. The elongated support member 12 further includes an upper surface 38 (the top side 22 of the upper plate 14) and a lower surface 40 (the bottom side 28 of the lower plate 16).

The support member 12 further includes a shelf extension assembly 56, the shelf extension assembly including a pair of extendable/retractable shelf extensions 60 that are each attached to the support member 20, wherein each shelf extension 60 can be extended from and retracted into the cavity 50 through an open end 36 of the support member to extend the length of the support member along its longitudinal axis beyond each side of the wheeled personal container. For example, as shown by the drawings, each shelf extension 60 can include a rear leg 62 and an opposing front leg 64 that longitudinally extend from and retract into the cavity 50 of the support member 20. The rear legs 62 and front legs 64 are positioned parallel to one another and attached together at their outside ends by crossbars 66. The support shelf 10 includes stops (not shown) positioned in the cavity 50 to prevent the legs 62 and 64 from coming completely out of the cavity. For example, the stops can be spring loaded or otherwise outwardly biased taps (like an umbrella stop) that are attached to the legs 62 and 64.

Figure 4:
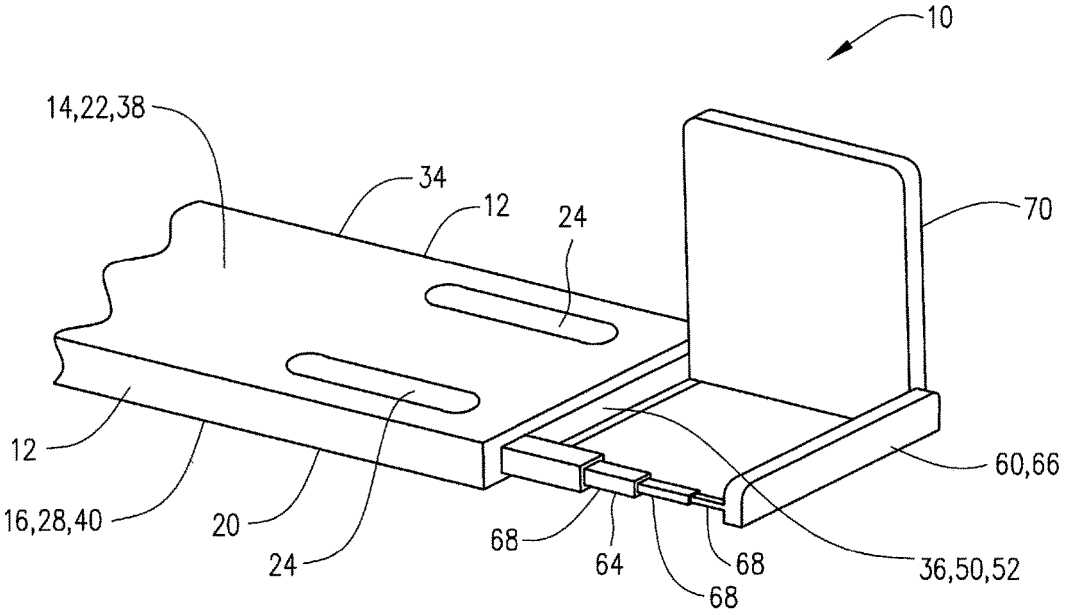
FIG. 4 is a perspective view of an alternative embodiment of the legs of the shelf extension assembly.
Figure 5:
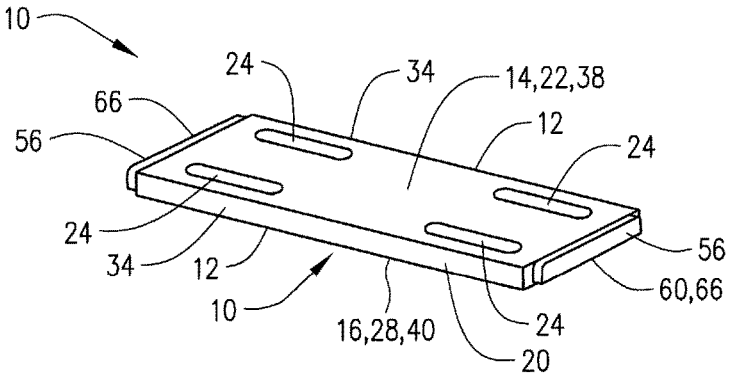
FIG. 5 is a top perspective view illustrating the embodiment of the personal wheeled container exterior support shelf shown by FIG. 1 with the shelf in a retracted position and the flaps in a closed position.
Figure 5:
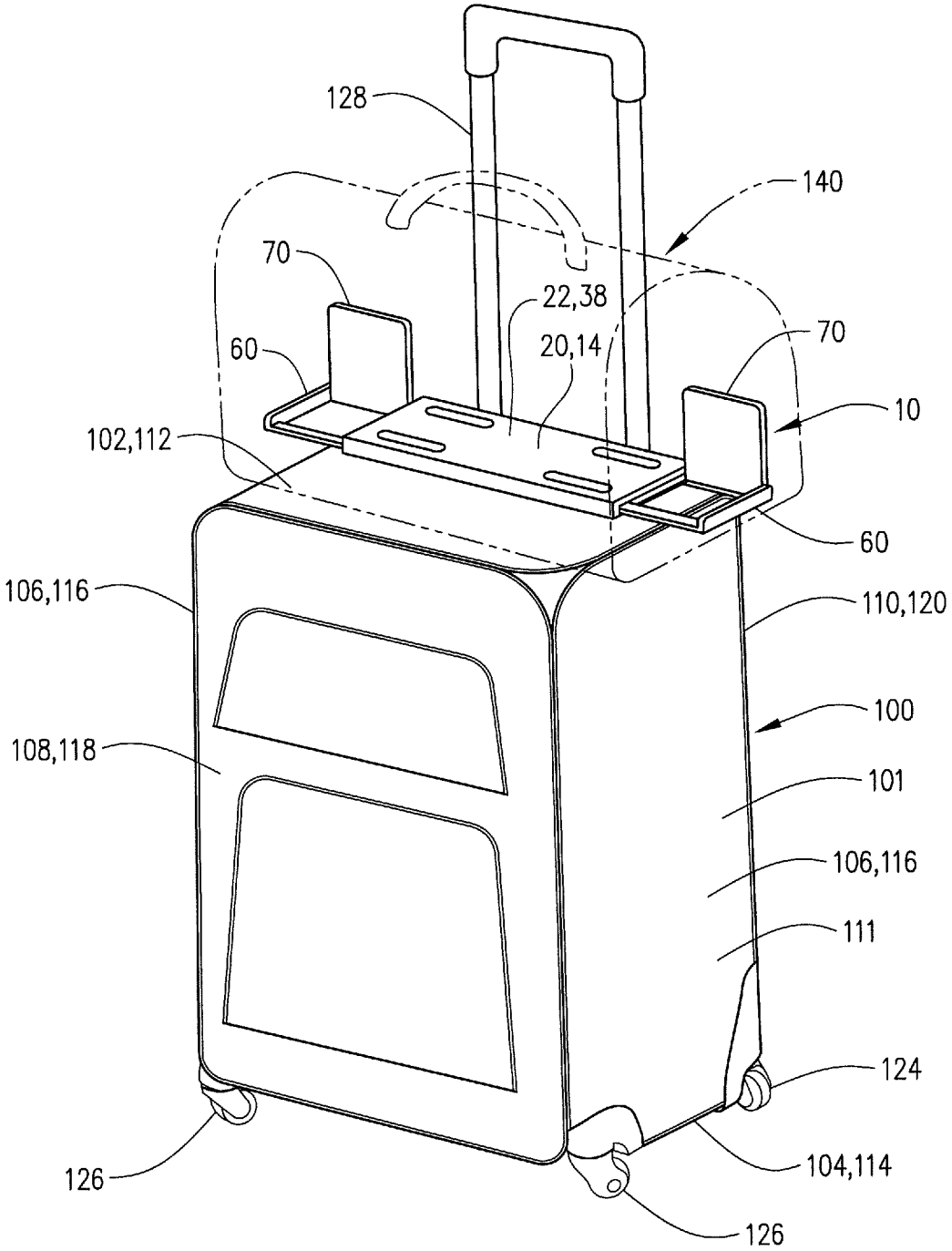

In an alternative embodiment, as shown by FIG. 4, each leg 62 and 64 can have a telescopic structure and function, for example, to allow the legs and shelf extensions 60 to extend out further from the cavity 50. In this embodiment, each of the legs 62 and 64 includes a plurality of sections 68 telescopically attached to each other. In other words, as shown by FIG. 4, three sections 68 can be used with each section having a smaller outside diameter than the preceding section and at least the first and second (middle) sections being hollow whereby the second (middle) section can retract into the first section and the third section can retract into the second section.

The elongated support member 12 further includes a flap 70 pivotally attached to each extendable/retractable shelf extension 60. For example, as shown in the drawings, each pivotal flap 70 can have a flat shape and be attached to each rear leg 62 of each shelf extension 60. For example, a flat shape of the flaps 70 facilitates extension and retraction of the shelf assemblies 60 into the cavity 50 of the support member 20 and support of supplemental items placed on top of the support shelf 10. The flaps 70 and can be pivoted (e.g., folded up and down) between a first position 72*a* and a second position 72*b*. When the flaps are in the first position 72*a* (shown by FIG. 1), each flap 70 extends upwardly from and perpendicularly to the upper plate 14 and the lower plate 16 (as the support shelf 10 is oriented in the drawings). In this position, the flaps 70 can support a supplemental item placed on top of the support shelf 10 and help keep the item from sliding off the support shelf when the personal wheeled container is tilted toward the user. When the flaps are in the second position (shown by FIG. 2), each flap 70 is coplanar to the upper plate 14 and the lower plate 16, and positioned between the corresponding rear leg 62 and front leg 64 of the corresponding shelf extension 60, such that the flap can be retracted into and out of the cavity 50 with the corresponding shelf extension. Even when the shelf extensions 60 are extended and the support shelf 10 is set up for use, the flaps may be positioned in the second position if the second position better supports the supplemental item. Thus, when the support shelf 10 is not needed, the flaps 70 can be easily folded to the second position and retracted with the shelf extensions 60 into the cavity 50. For example, in this manner, the size and footprint of the support shelf 10 can be minimized to allow the personal wheeled container to be more easily used or stored once the supplemental item is removed. Placing the support shelf 10 in its retracted position also prevents the support shelf from being broken when it is not in use. When the support shelf 10 is needed, the shelf extensions 60 can be easily extended out of the cavity 50 and the flaps 70 can be easily folded to the first position.

The support shelf 10 can be formed of a variety of materials. For example, the support shelf 10 including all of the components thereof can be formed of one or more non-metal materials to allow the support shelf to more easily pass through metal detectors and security check points. For example, the support shelf 10, including the shelf extensions 60, flaps 70 and other components of the support member 12, can be formed of plastic, for example, a hard industrial plastic.

The Personal Wheeled Container

Figure 7:
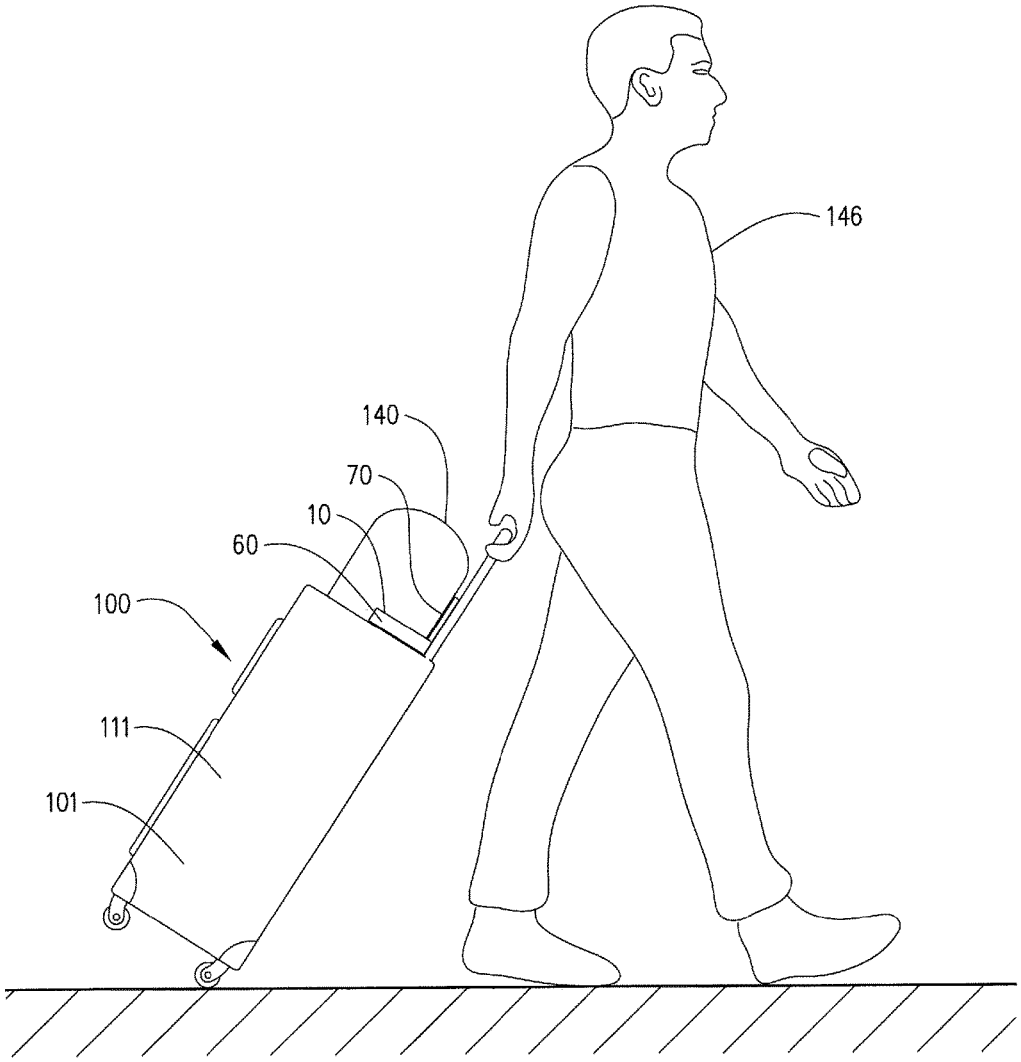
FIG. 7 is another view of the embodiment of the wheeled personal container shown by FIG. 6.
Figure 5:
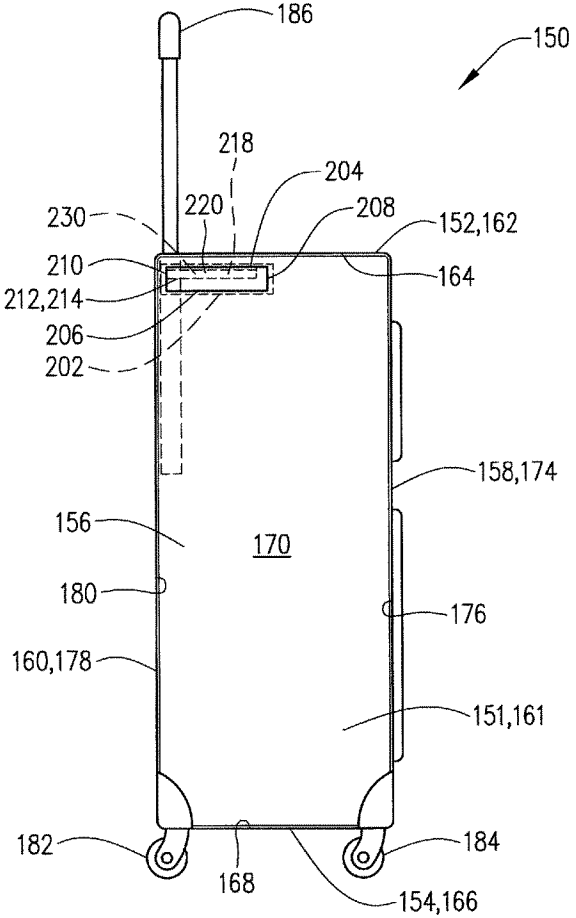
Figure 6:
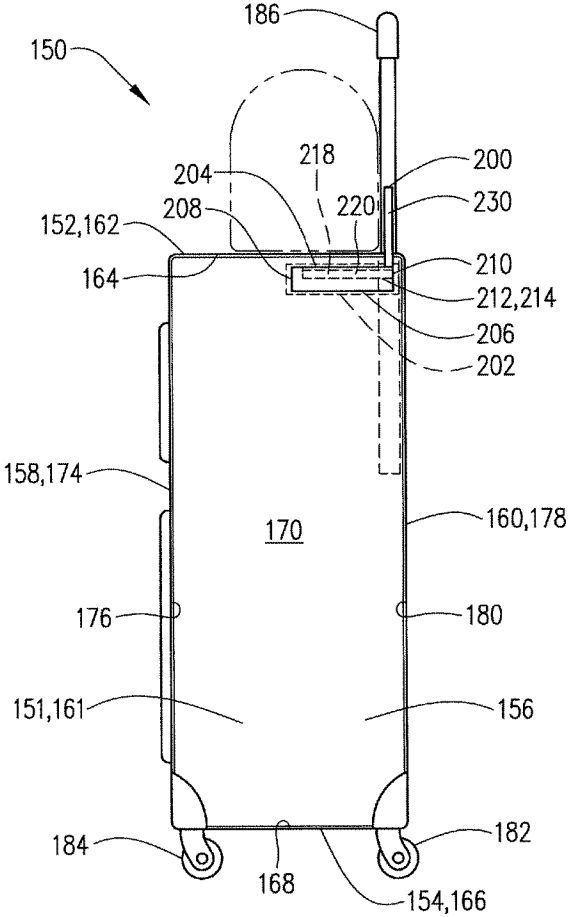
FIG. 6 illustrates one embodiment of the wheeled personal container of the present disclosure.
Figure 5B:
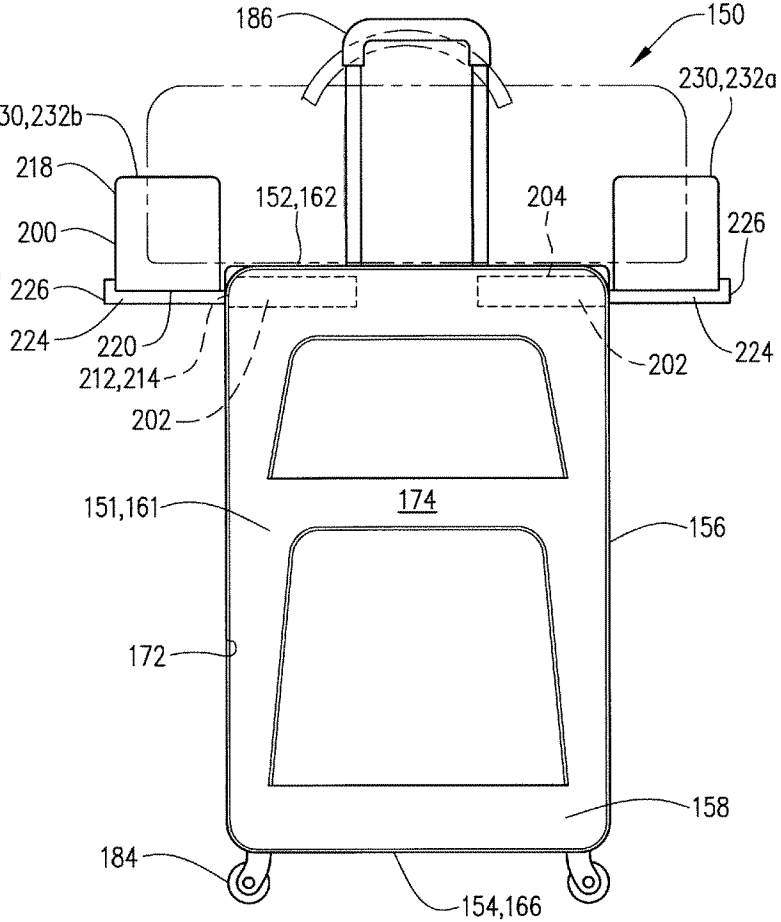
Figure 5A:
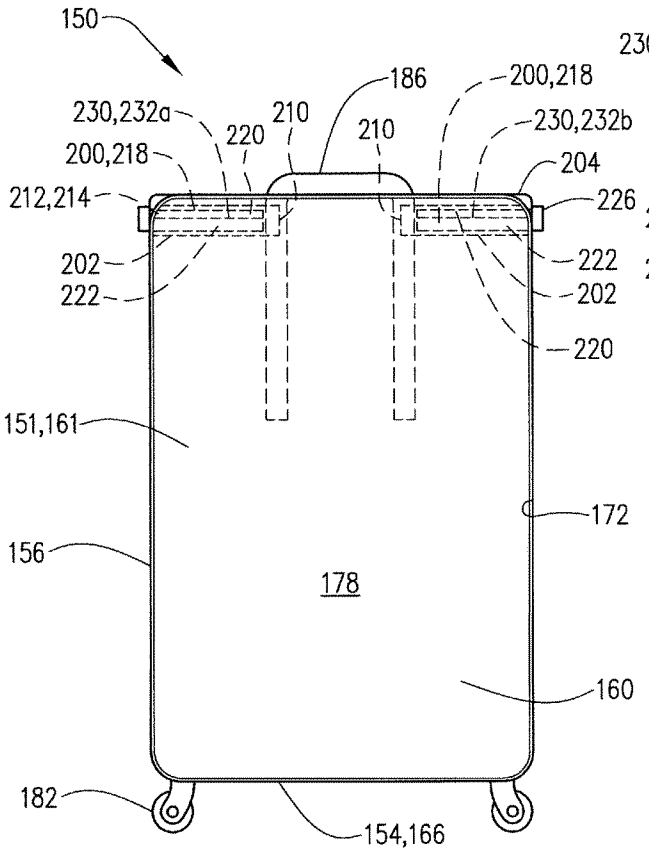
Figure 10:
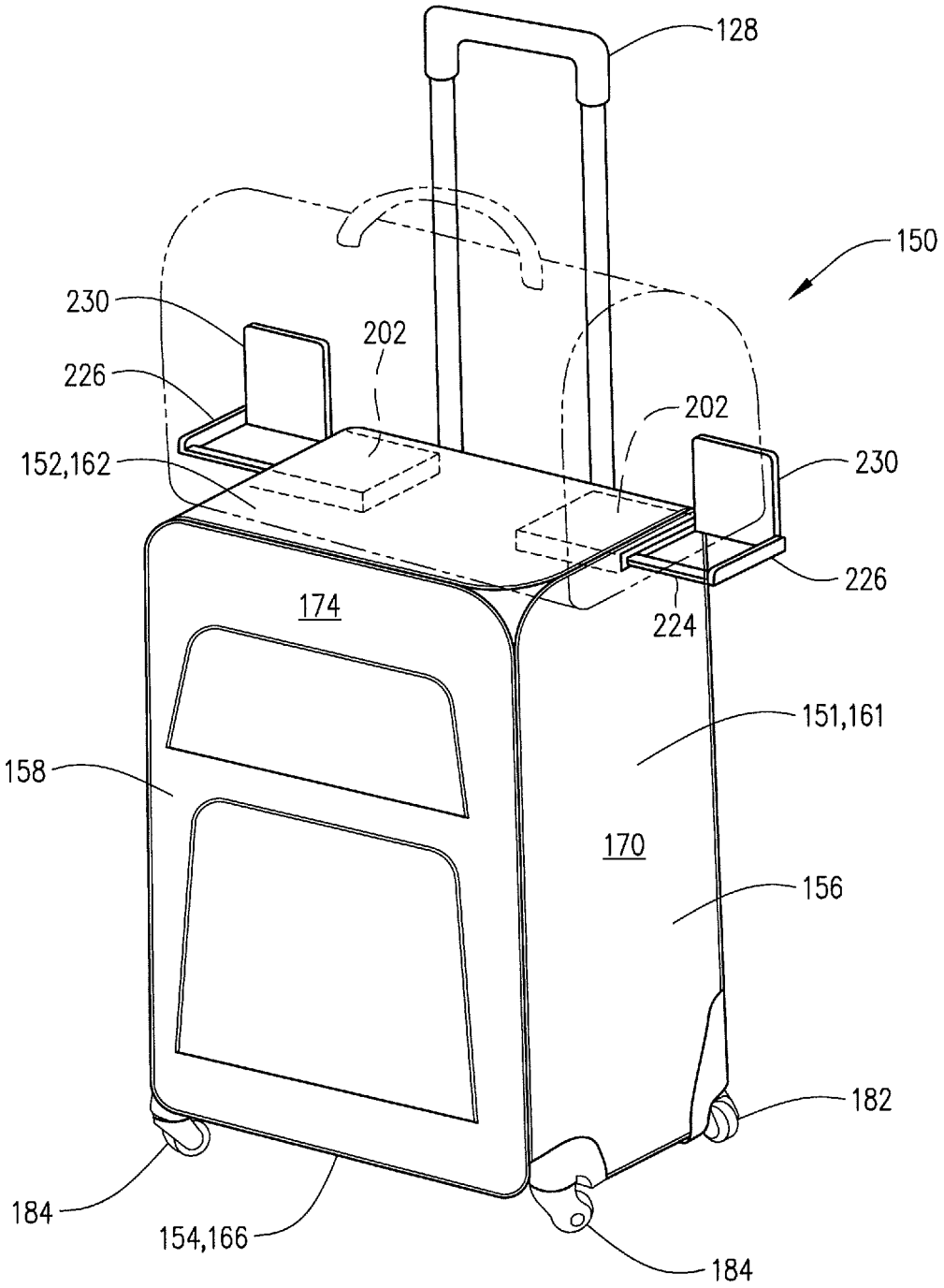
FIG. 10 is a perspective view of the embodiment of the personal wheeled container shown by FIGS. 8A, 8B, 9A and 9B, also showing a supplemental piece of luggage positioned thereon.
Figure 11:
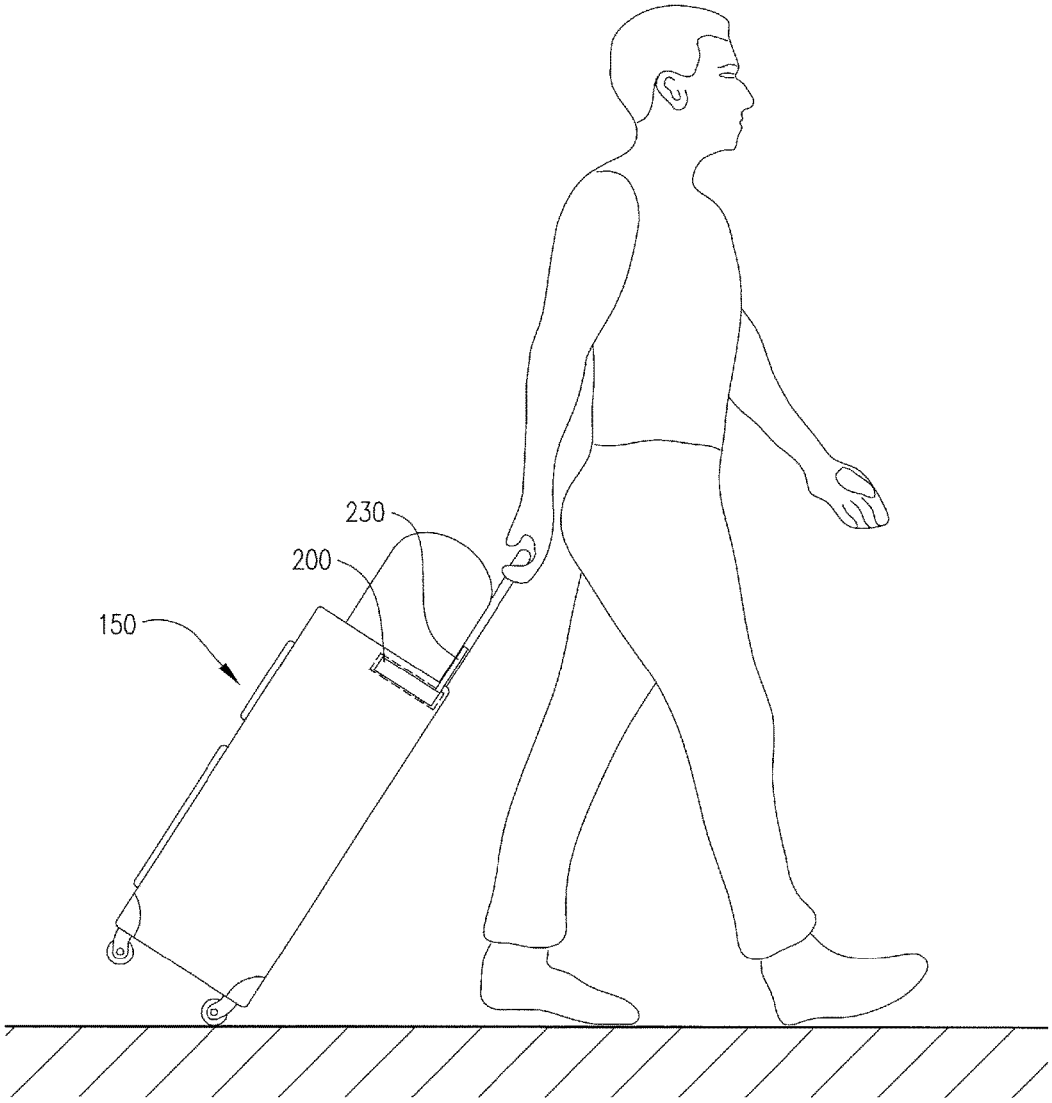
FIG. 11 further illustrates the embodiment of the personal wheeled container of the present disclosure shown by FIGS. 8A-10.

Referring now to FIGS. 6 and 7, one embodiment of the wheeled personal container disclosed herein is illustrated and generally designated by the numeral 100. In this embodiment of the wheeled personal container, the support shelf 10 is removably attached to a wheeled personal container (as illustrated, a piece of luggage).

The container 100 includes a body 101 including a first end 102, a second end 104 opposing the first end (not directly shown as the container is oriented in the drawings), a pair of opposing sides 106 attaching the first end and the second end together (left side 106 not directly shown as the container is oriented in the drawings), a top 108, and a bottom 110 opposing the top (not directly shown as the container is oriented in the drawings). The body 101 has an outside surface 111. Specifically, the first end 102 has an outside surface 112. The second end 104 has an outside surface 114 (not directly shown as the container is oriented in the drawings). Each side 106 has an outside surface 116 (left outside surface 116 not directly shown as the container is oriented in the drawings). The top 108 has an outside surface 118, and the bottom 110 has an outside surface 120 (not directly shown as the container is oriented in the drawings).

Two wheels 124 (left rear wheel 124 not shown as the container is oriented in the drawings) are attached to the body 101 and extend from (below) the outside surface 114 of the second end 104 of the container. Similarly, two wheels 126 are attached to the body 101 and extend from (below) the outside surface 114 of the second end 104 of the body on the side of the second end opposite to the side of the second end from which the wheels 124 extend.

A pull handle 128 is attached to the body 101 of the container 100 adjacent to the first end 102 and bottom 110 of the container 100. For example, the handle 128 can have can have a telescopic structure and function, for example, to allow the handle to be retracted such that the top of the handle is adjacent to the first end 102 of the container 100. A telescopic pull handle makes the pull handle adjustable for the user and decreases the space it takes when in a retracted position. The first end 102 of the body 101 of the container 100 is the top side of the container when the container is standing upright on its wheels 124 and 126, as shown by the drawings. The top 108 of the body 101 is the top side of the container when the container is positioned to be opened (that is, resting on the bottom 110).

The exterior support shelf 10 is removably attached to the outside surface 111 of the body 101 of the container 100. As shown, when the support shelf 10 is attached to the body 101 of the container 100, the lower plate 16 of the support shelf 10 faces the outside surface 112 of first end 102 of the body 101 adjacent to the pull handle 128 of the container. The support shelf 10 can be removably attached to the personal container by a variety of methods. For example, the support member 20 can further include a slotted extension member (not shown) that extends outwardly from the rear side 34. The slot can be placed over the personal container pull handle to hold the support shelf 10 on the container. Alternatively, a strap (not shown) can be attached to the support member 20 for attaching the support shelf 10 to the pull handle. The strap can merely be wrapped around the pull handle to hold the support shelf in place.

In use, the extendable/retractable shelf extensions 60 are extended from the cavity 50 of the support member 20 through each open end 36 of the support member to longitudinally extend the support members beyond each side 106 of the container 100. The flaps 70 are raised to the first position as described above. As shown by FIGS. 6 and 7, a supplemental item 140, for example a supplemental piece of luggage (a duffle bag) as shown in the drawings, is placed on the top of the first end 102 of the container 100 (for example, including on top of the support shelf 10, namely the upper surface 38 thereof). The supplemental item 140 is supported by the shelf extensions 60 and the flaps 70 of the support member 10 as well as the pull handle 128 of the container 100. As best shown by FIG. 7, a user 146 (for example, a person) of the container 100 can tilt the container toward the user and pull or push the container to move the container with the supplemental item 140 positioned thereon.

The size of the support shelf 10 and the sizes of the individual components thereof can vary depending on the size of the luggage and the area of support needed. For example, the support shelf 10, including the pivotal flaps 70, can be much larger than what is shown by the drawings. For example, the side members 12, upper plate 14 and lower plate 16 of the shelf support 10 can be pre-sized to fit various sizes of containers, for example, sized to approximately match the width of the outside surface 112 of the first end 102 of the container 100 such that the shelf extensions 60 each extend out from the outside surface of the first end. For example, the sizes of the shelf extensions 60 and pivotal flaps 70 can increase as the size of the support shelf 10 in general increases. In this configuration, the support shelf 10 can be manufactured in different sizes to support personal wheeled containers having different sizes. Optionally, the side members 12, upper plate 14 and lower plate 16 can each be longitudinally adjustable in order to allow the shelf support 10 to be adjustable to fit wheeled personal containers having different sizes.

Referring now to FIGS. 8A-11, a second embodiment of the wheeled personal container disclosed herein is illustrated and generally designated by the numeral 150. In this embodiment of the wheeled personal container, the personal wheeled container 150 has an exterior support shelf assembly 200 integrated therein.

The container 150 includes a body 151 including a first end 152, a second end 154, a pair of sides 156, a top 158, and a bottom 160 opposing the top. The body 151 has an outside surface 161. Specifically, the first end 152 has an outside surface 162 and an inside surface 164. The second end 154 has an outside surface 166 and an inside surface 168. Each side 156 has an outside surface 170 and an inside surface 172. The top 158 has an outside surface 174 and an inside surface 176, and the bottom 160 has an outside surface 178 and an inside surface 180.

Two wheels 182 are attached to the body 151 of the container 150 and extend from (below) the outside surface 166 of the second end 154 of the body. Two wheels 184 are attached to the body 151 of the container 150 and extend from (below) the outside surface 166 of the second end 154 of the body on the side of the second end opposite to the side of the second end from which the wheels 182 extend.

An extendable/retractable pull handle 186 is attached to the body 151, specifically to the outside surface 162 of the first end 152 of the body. For example, the pull handle 186 can have a telescopic nature and function to make it adjustable for the user and decrease the space it takes when in a retracted position. The first end 152 of the body 151 is the top side of the body when the container is standing upright on its wheels, as shown by the drawings. The top 158 of the body 151 is the top side of the container when the container is positioned to be opened (that is, resting on the bottom 160).

The exterior support shelf assembly 200 is attached to the body 151 and integrated into the container 150. The exterior support shelf assembly 200 includes a pair of opposing shelf housings 202 positioned in the body 151 of the container 150. The opposing shelf housings 202 are each positioned adjacent to the first end 152 of the body 151, specifically just below the inside surface 164 of the first end 152 of the body 151, and adjacent to a side 156 of the container. Each opposing shelf housing 202 includes a top 204, an opposing bottom 206 spaced from the top, a rear end 208 connecting the top and bottom together and an open front end 210 opposing the rear end. Each side 156 of the body 151 includes an opening 212 over an open front end 210 of a corresponding shelf housing 202.

A shelf extension subassembly 218 is attached to the exterior support shelf assembly 200. The shelf extension subassembly includes an extendable/retractable shelf extension 220 positioned within each shelf housing 202. Each shelf extension 220 can be extended from within and retracted into the corresponding housing 202 through the corresponding opening 212 in the corresponding side 156 of the body 151 of the container 150 in order to longitudinally extend the shelf extension 220 beyond each side of the body. Each shelf extension 220 includes a rear leg 222 and an opposing front leg 224 that longitudinally extend from and retract into the corresponding housing 202. The rear legs 222 and front legs 224 are positioned parallel to one another and attached together at their outside ends by crossbars 226. The support shelf assembly 200 can include stops (not shown) positioned in the shelf housings 202 to prevent the legs 222 and 224 from coming completely out of the housings. For example, the stops can be spring loaded or otherwise outwardly biased taps (like an umbrella stop) that are attached to the legs 222 and 224.

In an alternative embodiment, each leg 222 and 224 can have a telescopic structure and function, for example, to allow the legs and shelf extensions 220 to extend out further from the cavity housings 202. In this embodiment, each of the legs 222 and 224 includes a plurality of sections 68 telescopically attached to each other as shown by FIG. 4. In other words, as shown by FIG. 4, three sections 68 can be used with each section having a smaller outside diameter than the preceding section and at least the first and second (middle) sections being hollow whereby the second (middle) section can retract into the first section and the third section can retract into the second section.

The exterior support shelf assembly 200 further comprises a flap 230 pivotally attached to each extendable/retractable shelf extension 220. For example, as shown in the drawings, each pivotal flap 230 can have a flat shape and be attached to each rear leg 222 of each shelf extension 220. For example, a flat shape of the flaps 230 facilitates extension and retraction of the shelf extensions 220 into the shelf housings 202 and support of supplemental items placed on top of the container 150. Each flap 230 can be pivoted (e.g., folded up and down) between a first position 232*a* (shown by FIG. 9A) and a second position 232*b* (shown by FIG. 9B). When the flaps 230 are in the second position 232*b*, each flap 230 extends upwardly from and perpendicularly to the first end 152 of the container 150 (as the container is oriented in the drawings). In this position, the flaps 230 can support a supplemental item placed on the outside surface 162 of the first end 152 of the container 150 and shelf extensions 220, and help keep the item from sliding off the container and shelf extensions when the personal wheeled container is tilted toward the user. When the flaps are in the first position 232*a*, each flap 230 is coplanar to the first end 152 of the container 150 (as the container is oriented in the drawings), and positioned between the rear leg 222 and front leg 224 of each the corresponding shelf extension 220, such that the flap can be retracted into and out of the shelf housing 202 with the corresponding shelf extension. Even when the shelf extensions 220 are extended and the support shelf assembly 200 is set up for use, the flaps 230 may be positioned in the second position if the second position better supports the supplemental item.

Thus, when the support shelf assembly 200 is not needed, the flaps 230 can be easily folded to the second position and retracted with the shelf extensions 220 into the shelf housings 202. For example, in this manner, the size and footprint of the support shelf 200 can be minimized to allow the personal wheeled container 150 to be more easily used or stored once the supplemental item is removed. Placing the support shelf assembly 200 in its retracted position also prevents the support shelf assembly from being broken. When the support shelf assembly 200 is needed, the shelf extensions 220 can be easily extended out of the shelf housings 202 and the flaps 230 can be easily folded to the first position.

The support shelf assembly 200 can be formed of a variety of materials. For example, the support shelf assembly 200 including all of the components thereof can be formed of one or more non-metal materials to allow the support shelf assembly to more easily pass through metal detectors and security check points. For example, the support shelf assembly 200, including the shelf extensions 220, flaps 230 and other components of the support shelf assembly 200 can be formed of plastic, for example, a hard industrial plastic.

The size of the support shelf assembly 200 and the sizes of the individual components thereof can vary depending on the size of the luggage and the area of support needed. For example, the support shelf assembly 200, including the shelf extensions 220 and flaps 230, can be much larger than what is shown by the drawings.

In the attached drawings, the personal wheeled container exterior support shelf and personal wheeled container having an exterior support shelf integrated therein are illustrated in connection with and as a piece of wheeled luggage. Although the dimensions of the components may vary, the same general structure and principals of operation apply whether the personal wheeled container is a piece of luggage, an ice chest or any other type of personal wheeled container.

Therefore, the present personal wheeled container exterior support shelf and personal wheeled container are well adapted to attain the ends and advantages mentioned, as well as those that are inherent therein. The particular examples disclosed above are illustrative only, as the present personal wheeled container exterior support shelf and personal wheeled container may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered or modified, and all such variations are considered within the scope and spirit of the present support shelf and container. While the personal wheeled container exterior support shelf and personal wheeled container are described in terms of "comprising," "containing," "having," or "including" various components, the personal wheeled container exterior support shelf and personal wheeled container can also, in some examples, "consist essentially of" or "consist of" the various components. Also, the terms in the claims have their plain, ordinary meaning unless otherwise explicitly and clearly defined by the patentee.

What is claimed is:

1. A personal wheeled container, comprising:

a body including a first end, a second end opposing the first end, a pair of opposing sides attaching the first end and the second end together, a top, and a bottom opposing said top, said body having an outside surface;

one or more wheels attached to said body;

a pull handle attached to said body;

an exterior support shelf removably attached to said outside surface of said body, said exterior support shelf including:

an elongated support member, said support member having a longitudinal axis and including:

an upper plate, an opposing lower plate, and a pair of side members that each extend along the longitudinal axis of said support member and attach said upper plate and said lower plate together, wherein said upper plate and said lower plate are attached together by said side members in a manner such that said upper plate and said lower plate are coplanar to one another and spaced apart to form a cavity between said upper plate and said lower plate that extends though said support member along the longitudinal axis of said support member;

a pair of opposing open ends, each open end forming an opening to said cavity; and a shelf extension assembly, said shelf extension assembly including a pair of extendable/retractable shelf extensions that are attached to said support member, wherein each shelf extension can be extended from and retracted into said cavity through an open end of said support member to extend the length of said support member along its longitudinal axis beyond each side of the wheeled personal container.

2. The personal wheeled container of claim 1, wherein said support member of said exterior support shelf further includes a flap pivotally attached to each said extendable/retractable shelf extension.

3. The personal wheeled container of claim 2, wherein each said flap can be pivoted between a first position and a second position, wherein when said flaps are in said first position, each said flap extends upwardly from and perpendicularly to said upper plate and said lower plate, and wherein said flaps are in said second position, each said flap is coplanar to said upper plate and said lower plate such that said flap can be retracted into and out of said cavity with said corresponding shelf extension.

4. The personal wheeled container exterior support shelf of claim 1, wherein said support shelf is formed of one or more non-metal materials.

5. The personal wheeled container exterior support shelf of claim 4, wherein said support shelf is formed of plastic.

6. A personal wheeled container having an exterior support shelf assembly integrated therein, comprising:

a body including a first end, a second end opposing the first end, a pair of opposing sides attaching the first end and the second end together, a top, and a bottom opposing said top, said body having an outside surface;

one or more wheels attached to said body;

a pull handle attached to said body;

an exterior support shelf assembly attached to said body and integrated into the container, said exterior support shelf including:

a pair of opposing shelf housings positioned in said body of said container, each shelf housing being positioned adjacent to said first end of said body and adjacent to a side of said container and including a top, an opposing bottom spaced from said top, a rear end connecting said top and said bottom together and an open front end opposing said rear end, wherein each side of said body includes an opening over an open front end of a corresponding shelf housing;

a shelf extension subassembly attached to said exterior support shelf assembly, said shelf extension subassembly including an extendable/retractable shelf extension positioned within each shelf housing, wherein each shelf extension can be extended from within and retracted into said corresponding housing through said corresponding opening in said corresponding side of said body in order to longitudinally extend said shelf extension beyond each side of said body; and a flap pivotally attached to each said extendable/retractable shelf extension, wherein each said flap can be pivoted between a first position and a second position, wherein when said flaps are in said first position, each said flap extends upwardly from and perpendicularly to said first end of said body of the container, and wherein when said flaps are in said second position, each said flap is coplanar to said first end of said body of the container such that said flap can be retracted into and out of a shelf housing with said corresponding shelf extension.

7. The personal wheeled container of claim 6, wherein said support shelf is formed of one or more non-metal materials.

8. The personal wheeled container of claim 7, wherein said support shelf is formed of plastic.

9. A personal wheeled container exterior support shelf that can be attached to an existing personal wheeled container, comprising:

an elongated support member, said support member having a longitudinal axis and including:

an upper plate, an opposing lower plate, and a pair of side members that each extend along the longitudinal axis of said support member and attach said upper plate and said lower plate together, wherein said upper plate and said lower plate are attached together by said side members in a manner such that said upper plate and said lower plate are coplanar to one another and spaced apart to form a cavity between said upper plate and said lower plate that extends though the support member along the longitudinal axis of the support member;

a pair of opposing open ends, each open end forming an opening to said cavity;

a shelf extension assembly, said shelf extension assembly including a pair of extendable/retractable shelf extensions that are each attached to said support member, wherein each shelf extension can be extended from and retracted into said cavity through an open end of said support member; and a flap pivotally attached to each said extendable/retractable shelf extension, wherein each said flap can be folded up and down between a first position and a second position, wherein when said flaps are in said first position, each said flap extends upwardly from and perpendicularly to said upper plate and said lower plate, and wherein when said flaps are in said second position, each said flap is coplanar to said upper plate and said lower plate such that said flap can be retracted into and out of said cavity with said corresponding shelf extension.

10. The personal wheeled container exterior support shelf of claim 9, wherein said support shelf is formed of one or more non-metal materials.

11. The personal wheeled container exterior support shelf of claim 10, wherein said support shelf is formed of plastic.

* * * * *